United States Patent [19]

Greenhalgh

[11] Patent Number: 4,684,790

[45] Date of Patent: Aug. 4, 1987

[54] SMOKE AND/OR HEAT DETECTION APPARATUS CONTAINING THERMAL-SENSITIVE INSULATING COMPOSITION

[75] Inventor: Milton Greenhalgh, Fairfield, Conn.

[73] Assignee: General Electric Company, Bridgeport, Conn.

[21] Appl. No.: 858,370

[22] Filed: May 1, 1986

Related U.S. Application Data

[63] Continuation-in-part of Ser. No. 709,245, Mar. 7, 1987, Pat. No. 4,616,124, and a continuation-in-part of Ser. No. 548,376, Nov. 3, 1983, Pat. No. 4,617,454.

[51] Int. Cl.[4] ..... H05B 1/02

[52] U.S. Cl. ..... 219/505; 219/506; 340/629

[58] Field of Search ..... 219/491, 490, 494, 212, 219/501, 506, 504, 505, 549, 528; 338/22 R, 22 SD, 214; 526/340, 341, 335; 340/584, 628, 629

[56] References Cited

U.S. PATENT DOCUMENTS

| | | | |
|---|---|---|---|
| 2,581,212 | 1/1952 | Spoone, Jr. et al. | 219/495 |
| 2,745,944 | 5/1956 | Price | 219/505 |
| 3,493,727 | 2/1970 | Hosokawa et al. | 219/505 |

*Primary Examiner*—M. H. Paschall

*Attorney, Agent, or Firm*—Hedman, Gibson, Costigan & Hoare

[57] ABSTRACT

There is disclosed a smoke and/or heat detection apparatus including smoke and/or fire detectors, wire conductors embedded in a coextensive body of thermoplastic material and signal and actuating means.

11 Claims, 3 Drawing Figures

FIG. 1
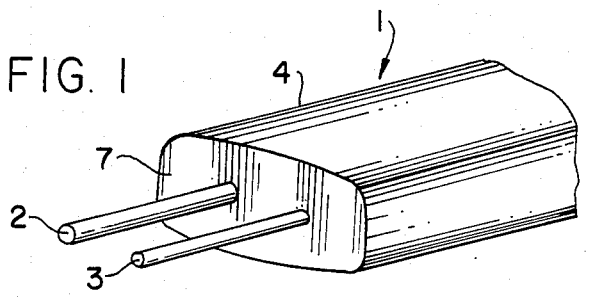
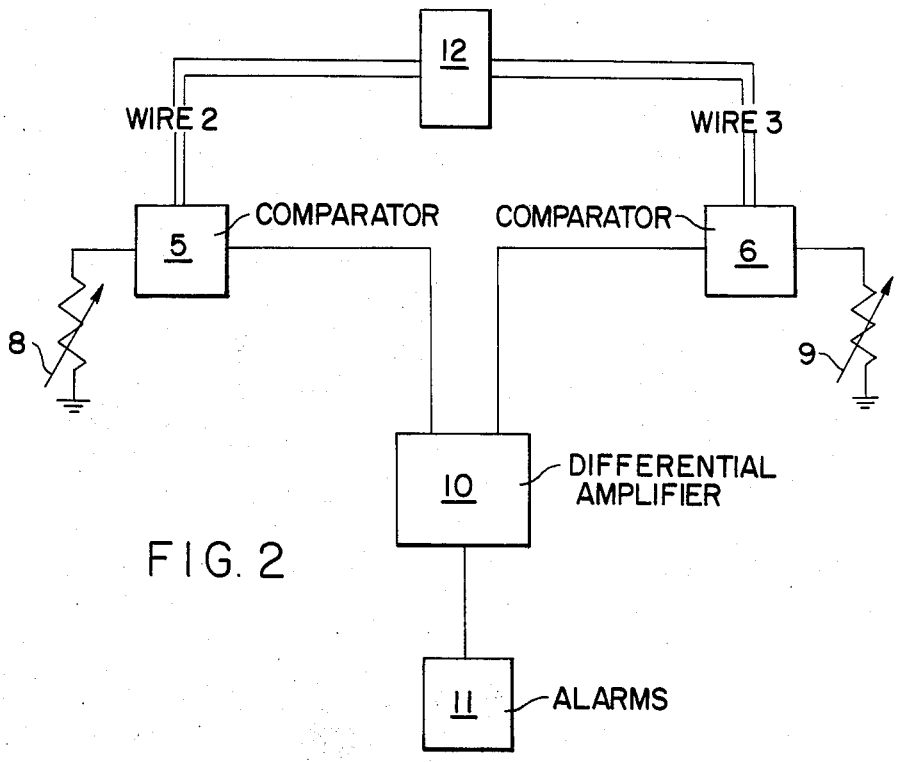
FIG. 2
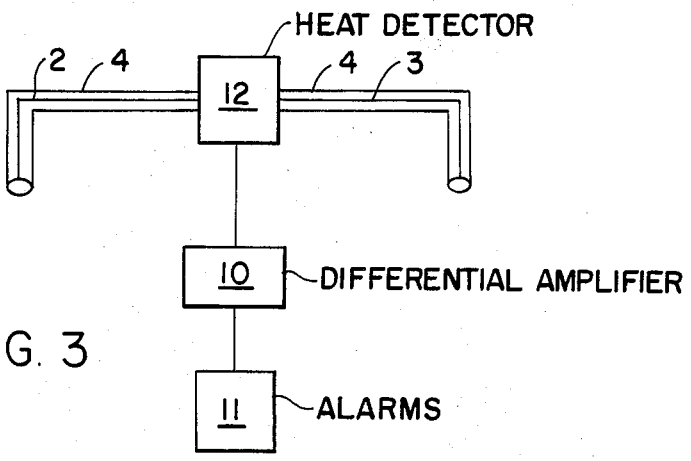
FIG. 3

SMOKE AND/OR HEAT DETECTION APPARATUS CONTAINING THERMAL-SENSITIVE INSULATING COMPOSITION

This is a continuation-in-part application of copending Ser. No. 709,245 filed Mar. 7, 1985 U.S. Pat. No. 4,616,124 and Ser. No. 548,376 filed Nov. 3, 1983 U.S. Pat. No. 4,617,454.

FIELD OF THE INVENTION

The present invention relates generally to smoke and/or heat detection devices and more particularly to the use of thermal-sensitive conductors which effectively respond to the presence of smoke and/or heat.

BACKGROUND OF THE INVENTION

Insulating materials having temperature-dependent electrical resistance or capacitance characteristics have long been extensively used in overheat sensing and control applications. Thus, by virtue of the invention of Spooner and Greenhalgh disclosed and claimed in U.S. Pat. No. 2,581,212 overheat protection for electric blankets and similar articles is provided for the use of such materials to afford the essential safety factor. In accordance with the teachings of that patent, the insulating material is operatively associated with switch means and is coextensive with the heating element so that when the temperature anywhere in the blanket exceeds a predetermined maximum, the blanket heating power supply is interrupted. Because this insulating material is not altered physically or otherwise irreversibly changed in so functioning, it is useful repeatedly for this purpose as it acts as a sort of electrical switch constantly monitoring the blanket operating temperature limit.

A variety of insulating materials are identified in the prior art as being suitable for such use. Those include in addition to the preferred Nylon polyamide resin of the aforesaid patent, polymeric organic materials such as polyvinyl chloride and cellulose esters containing additives imparting the desired electrical characteristics. In U.S. Pat. No. 2,745,944 to Price, still another kind of material for this same purpose, sulfur-cured butadiene-acrylonitrile elastomer is disclosed. That material and all the others of the prior art, however, are in one respect or another, less than what has been desired and general recognition of that fact has failed heretofore to result in a thermal-sensing insulating material approaching the ideal which would combine the best properties and characteristics of each of those, but would be free, at least to a large degree, from their major drawbacks which are relatively low levels and ratios of changes in impedance with temperature and, in the case of DC volume resistivity, high levels of volume resistivity and low ratios of changes in volume resistivity to temperature. In addition as in the case of Nylon resin, the effect of humidity shifts the levels of impedance resistivity to the extent that control circuits become a problem.

The practical significance of such shortcomings of prior art thermal-sensing materials is apparent from the commercial electric blanket experience. Thus when exposed to moisture, the Nylon insulation temporarily loses its desirable electric properties to a large extent in only an hour or two even though the insulation in an electric blanket is covered by a layer of polyethylene and an overlayer of polyvinyl chloride as described in the Spooner and Greenhalgh patent reference above.

The catastrophic effect of the presence of free sulfur in thermal-sensing insulation on wires of the type used in electric blanket structures has been demonstrated in tests under normal operating conditions running only six hours to wire failure.

U.S. Ser. No. 709,245 now U.S. Pat. No. 4,616,124 (Greenhalgh) filed Mar. 7, 1985 incorporated herein by reference discloses a new class of thermal-sensitive insulating compositions which applicant has discovered are particularly suited for use in smoke and/or heat detectors. Broadly speaking, the compositions are comprised of an admixture of a polymeric material, a filler, a plasticizer, etc. in proportion to optimize the desired electrical, physical and processing characteristics to achieve the product.

The polymeric material selected should contain substantially no free sulfur. In the case of the acrylonitrile butadiene formulations, the acrylonitrile must be present in an amount of at least 1%; and for the carboxylated material, the acid monomer units should be present in an amount of at least 0.5%.

In addition to being curable by either sulfur-bearing combinations or peroxide, the carboxylated polymer can be cured by zinc oxide. Further, both polymers (carboxylated and non-carboxylated acrylonitrile butadiene) can be used as plasticizers for such a resin as polyvinyl chloride.

In practice, as indicated above, acrylonitrile butadiene rubber of the relatively high acrylonitrile type which has S.I.C. ratios (90° C. to room temperature) of the order of 10 or more are employed. Those materials preferably contain about 20% to 45% acrylonitrile by weight. Also, preferably acrylonitrile butadiene rubbers contain carboxyl groups which further enhance the desired electrical properties of interest, these being introduced by copolymerization with acrylonitrile and butadiene commonly derived from acrylic acid, methylacrylic acid, maleaic acid or the like. Preferably, the amount of carboxyl groups is more than the minimum of 0.5% by weight. Suitable polymers available on the market are set out in Table I.

TABLE I

| | % Butadiene | % Acrylo-Nitrile | % Carboxyl |
|---|---|---|---|
| Goodyear NX775 | 68 | 26 | 6 |
| Goodrich 1072 | 67 | 27 | 6 |
| Polysar 110C | 64 | 32 | 2 |
| Polysar 231C | 59 | 34 | 7 |

As with acrylonitrile butadiene elastomers, the curing system involves sulfur in the free state, sulfur bearing in which sulfur is available in combined form, and peroxide. In addition, carboxylated acrylonitrile butadiene combinations may be cured with a metallic oxide such as zinc oxide which is the preferred curing system. The amount of zinc oxide for this purpose may be from 1 to 10 pts to 100 pts. of elastomer.

In addition to the superior desired electrical properties carboxylated elastomers in the cured state have the additional attributes of increased hardness, tensile strength, ozone resistance, and abrasion resistance.

When it is not possible to cure the polymeric material on a conductor, blends of either the acrylonitrile butadiene or the carboxylated acrylonitrile butadiene may be used in combination with a suitable resin such as polyvinyl chloride. In either cure, the elastomer acts as a migratory plasticizer and the mixture is considered to be pure thermoplastic. The preferred ratios of resin to elastomer are in the range of 1 to 4 to 1 to 1, respectively.

The combinations referred to above when containing a carboxylated elastomer have the additional advantage of retaining the inherent properties of the carboxylated elastomer even in the uncured state.

Additionally, clay, and particularly a kaolin such as Catalpo clay (Freeport Kaolin Company trademark) enhances the S.I.C. ratio and the volume resistance.

A further application is disclosed in U.S. Ser. No. 847,481 (Greenhalgh) filed Apr. 3, 1986 incorporated herein by reference wherein temperature fluctuations in power cables are monitored using the same polymeric material as disclosed in U.S. Ser. No. 709,245 or in Ser. No. 858,351 filed as of even date herewith, both of which are incorporated herein by reference.

The construction and operation of smoke detectors and heat (fire) detectors and devices containing both features are well known.

For example, single and dual ionization chambers are disclosed in "Ionisation Type Smoke Detector Technology" by Michael Byrne May 13, 1981, incorporated herein by reference. In a single chamber design, a radioactive source emits alpha particles to disloge electrons from air molecules to thereby produce positive ions. The electrons almost immediately attach themselves to other molecules thus producing negative ions.

When a voltage is applied between the electrodes these ions will drift under the influence of the electric field and so constitute a current. If smoke particles enter the region between the plates some of the ions will become attached to them by diffusion. This causes a reduction in the current flowing because the smoke particles are far too massive for the electric field between the plates to deflect them appreciably. This decrease in current is detected and used to trigger the alarm.

The dual ionization chamber design contains a smoke sensing chamber which has access to the ambient air and another, reference chamber, which is almost completely sealed. The two chambers are connected in series. The relative geometries of the chambers are arranged such that the reference chamber, because the voltage across it is high enough, operates in the saturation region of its characteristic. The smoke chamber is operated in its linear region as this is where it was most sensitive to smoke. When smoke enters the chamber the ion concentration (contributing to the ionization current) is reduced. However, because the reference chamber, from an electrical point of view is essentially a constant current source, the voltage across the smoke chamber increases, thereby providing the means for the generation of an electrical signal in response to the presence of smoke and/or heat.

Improvements in ionization smoke detectors have been made in recent years as disclosed for example, in U.S. Pat. Nos. 4,185,196, 4,185,197 and 4,220,262 all incorporated herein by reference.

Other types of smoke and/or heat detectors are familiar to those skilled in this art.

Despite all of the recent attention to smoke and/or heat detectors there is still a need for improving the electrical insulating capabilities of conductors employed in such devices so that the devices have improved levels and ratios of changes in impedance with temperature and, in the case of DC-volume resistivity, high levels of volume resistivity and low ratios of changes in volume resistivity to temperature. In addition, improvements in resistance to humidity changes to thereby reduce shifts in the levels of impedance resistivity are also desired.

It is therefore an object of the invention to provide an improved smoke and/or heat detector which is sensitive to low levels of heat and smoke and more resistant to changes in humidity levels.

It is a further object of the invention to provide a smoke and/or heat detector with improved temperature/impedance ratios.

SUMMARY OF THE INVENTION

The present invention is directed to a smoke and/or fire detection apparatus which comprises a smoke and/or fire detection means such as an ionization chamber as used in ionization smoke detectors or other similar devices known to those skilled in the art.

A first wire reference conductor and a second sensing wire conductor are both connected to an electric power source and operatively connected to the smoke and/or fire detection means.

The first and second wires are uniformly spaced apart over their full lengths and are embedded in a coextensive body of a thermosensitive polymeric material which may be a thermosetting acrylonitrile butadiene rubber or a thermoplastic blend of a polyvinyl chloride and an acrylonitrile butadiene rubber containing at least one percent of acrylonitrile. The thermoplastic rubber after curing and the thermoplastic blend are substantially free of sulfur.

Also included in the apparatus of the present invention is an actuating means operatively associated with a signal means and the first and second wires which actuates the signal means when the DC resistance between the first and second wires exceeds a predetermined maximum.

BRIEF DESCRIPTION OF THE DRAWINGS

Those skilled in the art will gain a further and better understanding of the present invention in all its aspects upon consideration of the detailed description set forth below, taken in conjunction with the drawings accompanying and forming a part of this specification, in which:

FIG. 1 is a perspective view, with parts broken away, of a pair of parallel conductors for use in the present invention, the conductors being embedded in the thermosensitive composition in a manner such that temperature measurements between the two conductors by the composition of the insulation material can be made to monitor the system for smoke and/or heat control purposes;

FIG. 2 is a diagram of a temperature-sensing smoke and heat detection alarm system in accordance with the present invention.

FIG. 3 is a diagram of another embodiment of a temperature-sensing smoke and heat detection alarm system.

DETAILED DESCRIPTION OF THE DRAWINGS

In the practice of this invention, acrylonitrile butadiene rubber of the relatively high acrylonitrile type which has S.I.C. ratios (90° C. to room temperature) of the order of 10 or more is employed as disclosed in U.S. Ser. No. 709,245.

FIG. 1 shows a structure which is utilized in a typical smoke and/or heat detection system. An insulated structure 1 includes copper wires 2 and 3 which are spaced about 10 mils apart and insulated and united in an integral structure with a layer of temperature-sensing material 4 which is co-extensive with the wires. This construction is apparent in the perspective view of this drawing.

FIG. 2 is a diagram which illustrates a looped circuit which may be used in the apparatus of this invention. The apparatus involved is a temperature-sensitive smoke and/or heat detection device which is actuated to sound or otherwise signal a smoke or overheat condition whenever the difference in temperature between the control or ambient conductor and the sensing conductor exceeds a predetermined maximum. More specifically, in the illustrated device, the DC resistance difference between wires 2 and 3, either of which may serve as the ambient reference is monitored continuously. Wire 2 is connected to comparator gate 5, while wire 3 is connected to comparator gate 6, the two wires being connected to a battery (not shown) and being coextensive and spaced about 10 mils apart over their lengths through a zone 7 to be temperature-monitored. Zone 7 consists of the portion of insulating sheath 4 disposed between wires 2 and 3.

At ambient smoke concentration and/or start up temperature, gates 5 and 6 are adjusted to the same voltage by balance controls 8 and 9, respectively. The two gates are again adjusted to a different common reference voltage which may be routinely determined to establish the sensitivity of the device. Then, with gates 5 and 6 in balance, differential gate 10 will monitor differences in potential and a sufficiently high voltage differential will trigger an alarm 11.

The wires 2 and 3 are connected to the smoke and/or heat detection means 12 such as an ionization chamber. As a result, when smoke and/or heat is generated in the smoke detection means, the signal is detected by the wires 2 and 3 interpreted in gates 5, 6 and 10 and detectable signal is registered by the alarm 11.

FIG. 3 shows a non-looped circuit wherein wires 2 and 3 are end-capped and therefore are not directly connected to the comparators 5 and 6. In this embodiment, the comparators 5 and 6 may be eliminated as shown in FIG. 3 or may be included as part of the differential amplifier.

Those skilled in the art will recognize that the specific means and components used for the purposes and functions of the comparator gates, balance controls, differntial gate and alarm device are the operator's choice to a substantial extent.

I claim:

1. A smoke and/or heat detection apparatus comprising:

(a) smoke and/or fire detection means;

(b) a first reference wire conductor and a second wire sensing conductor, both of which are connectable to an electric power source and operatively connected to said smoke and heat detection means, (c) signal means; and (d) actuating means operatively associated with the signal means and the first and second wires to actuate the signal means when D.C. resistance between the first and second wires exceeds a predetermined maximum, said first and second wires being uniformly spaced apart over their full lengths and embedded in a coextensive body of thermal sensitive polymeric material selected from the group consisting essentially of (1) a thermosetting acrylonitrile-butadiene rubber containing at least one percent by weight of acrylonitrile, and (2) a thermoplastic blend of a polyvinyl chloride and an acrylonitrile-butadiene rubber containing at least one percent of acrylonitrile, in which the thermoplastic rubber (1) after curing and thermoplastic blend (2) contain substantially no sulfur.

2. The apparatus fo claim 1, in which the ratio of specific inductive capacitance of the acrylonitrile-butadiene rubber from 90° C. to room temperature is greater than about 10.

3. The apparatus of claim 1, in which the acrylonitrile-butadiene rubber contains 20% to 45% by weight of acrylonitrile monomer units.

4. The apparatus of claim 1, in which the acrylonitrile-butadiene rubber of (1) or (2) contains at least 0.5 percent by weight of carboxylic acid monomer units.

5. The apparatus of claim 4, in which the thermosetting carboxylated acrylonitrile-butadiene rubber of (1) is cured with a metal oxide.

6. The apparatus of claim 5, in which the metal oxide is zinc oxide.

7. The apparatus of claim 1, in which the polymeric material is a thermoplastic blend of an acrylonitrile-butadiene rubber containing at least 5% of carboxylic acid monomer units and from 5% to 95% of polyvinyl chloride.

8. The apparatus of claim 7, in which the ratio of specific conductive capacitance of the polymer material at 90° C. to that at room temperature is greater than about 10.

9. The apparatus of claim 1, in which the polymeric material is admixed and compounded and zinc oxide is the curing agent and the mixture contains at least 7% kaolin clay, the compounded polymeric material having a specific inductive capacitance ratio at 90° C. and at room temperature greater than 30.

10. The apparatus of claim 1 wherein the smoke and/or fire detection means is at least one ionization chamber.

11. The apparatus of claim 1 wherein the first and second wires are uniformly spaced about 10 mils apart.

* * * * *